US006011360A

United States Patent [19]

Gradzki et al.

[11] Patent Number: 6,011,360

[45] Date of Patent: Jan. 4, 2000

[54] HIGH EFFICIENCY DIMMABLE COLD CATHODE FLUORESCENT LAMP BALLAST

[75] Inventors: Pawel M. Gradzki, Milford, Conn.; Wen-Jian Gu, Framingham, Mass.; Ihor T. Wacyk, Briarcliff Manor, N.Y.

[73] Assignee: Philips Electronics North America Corporation, New York, N.Y.

[21] Appl. No.: 08/932,986

[22] Filed: Sep. 18, 1997

Related U.S. Application Data

[60] Provisional application No. 60/039,697, Feb. 13, 1997.

[51] Int. Cl.[7] ..... H05B 37/00

[52] U.S. Cl. ..... 315/244; 315/209 R; 315/276; 363/20; 363/98

[58] Field of Search ..... 315/209 R, 224, 315/307, 308, 291, DIG. 4, DIG. 7, 244, 276, 283; 363/98, 17, 133, 20

[56] References Cited

U.S. PATENT DOCUMENTS 4,639,844 1/1987 Gallios et al. ..... 363/17
4,700,113 10/1987 Stupp et al. ..... 315/224
4,952,849 8/1990 Fellows et al. ..... 315/307
5,214,356 5/1993 Nilssen ..... 315/224
5,424,614 6/1995 Maheshwari ..... 315/209
5,495,405 2/1996 Fujimura et al. ..... 363/133
5,559,395 9/1996 Venkitasubrahmanian et al. ... 315/247
5,680,017 10/1997 Veldman et al. ..... 315/308

*Primary Examiner*—Haissa Philogene
*Attorney, Agent, or Firm*—Edward Blocker; Bernard Franzblau

[57] ABSTRACT

A ballast including an inverter and a circuit having a resonant frequency coupled to the output of the inverter. In one embodiment of the invention, the only discrete type of element substantially affecting the resonant frequency is substantially inductive in electrical character. In this embodiment of the invention, there is also no discrete ballasting element in series with the lamp load. The reduction in discrete elements reduces both power consumption and costs associated with the ballast.

24 Claims, 3 Drawing Sheets

Vg1

Vg2
Tdead

Vds
0 iL
0
Tdelay
Tfwd

HIGH EFFICIENCY DIMMABLE COLD CATHODE FLUORESCENT LAMP BALLAST

CROSS-REFERENCE TO RELATED APPLICATION

This application claims the benefit of U.S. Provisional Application No. 60/039,697, filed Feb. 13, 1997.

BACKGROUND OF THE INVENTION

This invention relates generally to a fluorescent lamp ballast and, more particularly, to a dimmable cold cathode fluorescent lamp (CCFL) ballast for liquid crystal display (LCD) backlighting of a laptop computer.

Efficiency, cost, and size are critical factors in the design of a CCFL ballast for LCD backlighting of a laptop computer. Conventional ballasts for LCD backlighting, such as ballasts sold by TDK Corporation of Tokyo, Japan, as part no. CXA-K05L-FS, include a buck converter and a current-fed self-oscillating push-pull inverter (also referred to as a Royer inverter). The overall efficiency of the combination of the buck stage and Royer inverter is inherently limited by the two power converter stages included therein. Additional power losses, inter alia, stem from the magnetizing inductance of the transformer within the Royer inverter serving as the resonant inductance. The typical efficiency of the buck stage combined with the Royer inverter is about 80%.

Another type of conventional ballast, such as part no. LXM1590/LXM1591 sold by Linfinity Microelectronics of Garden Grove, Calif., employs a half-bridge type inverter. The half-bridge type inverter is a more efficient ballast than the buck stage/push-pull type inverter combination. Similar to the push-pull type inverter, the half-bridge type inverter includes a transformer. The transformer in providing reactive power from its secondary winding to a ballasting capacitor in series with the lamp increases the circulating current. Real power losses from the increase in circulating current reduce the efficiency of the ballast. Alternatively, the transformer can be made larger in size to reduce winding resistance and thereby avoid the power losses resulting from the increase in circulating currents. Losses also arise from the equivalent series resistance (ESR) of a DC blocking capacitor. Typical efficiencies of a half-bridge type inverter are about 90%.

Accordingly, it is desirable to provide an improved ballast which is at least as efficient, less costly and smaller in size than a conventional ballast whether of the push-pull or half-bridge type.

SUMMARY OF THE INVENTION

Generally speaking, in accordance with one aspect of the invention, a ballast includes a switching stage and a circuit having a resonant frequency and coupled to the output of the switching stage. The only type of discrete element within the circuit substantially affecting the resonant frequency is substantially inductive in electrical character. In accordance with this first aspect of the invention, the ballast also has no discrete ballasting element in series with the lamp.

The elimination of discrete components from the circuit and serving as a ballasting element reduces both the parts count and cost of the ballast. Power losses are also reduced thereby improving ballast efficiency.

In lieu of conventional discrete components such as capacitors and coils for setting and controlling the resonant frequency, the ballast can include a transformer having leakage inductance and parasitic capacitances for affecting the resonant frequency. The circuit is typically coupled through the transformer to a lamp load having at least one lamp and a shield and characterized by a parasitic capacitance between the at least one lamp and shield. Through use of this non-discrete component, that is, through use of the parasitic capacitance of the lamp the resonant frequency can be further controlled.

Accordingly, it is an object of the invention to provide an improved ballast which is at least as efficient, less costly and includes less parts than a conventional ballast.

It is another object of the invention to provide an improved ballast which reduces the number of discrete elements controlling the resonant frequency of the ballast output circuit.

It is a further object of the invention to provide an improved ballast which eliminates all discrete ballasting elements coupled between the ballast output circuit and lamp load.

Still other objects and advantages of the invention, will, in part, be obvious and will, in part, be apparent from the specification.

The invention accordingly comprises several steps in a relation of one or more of such steps with respect to each of the others, and the device embodying features of construction, a combination of elements and arrangement of parts which are adapted to effect such steps, all as exemplified in the following detailed disclosure wherein the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
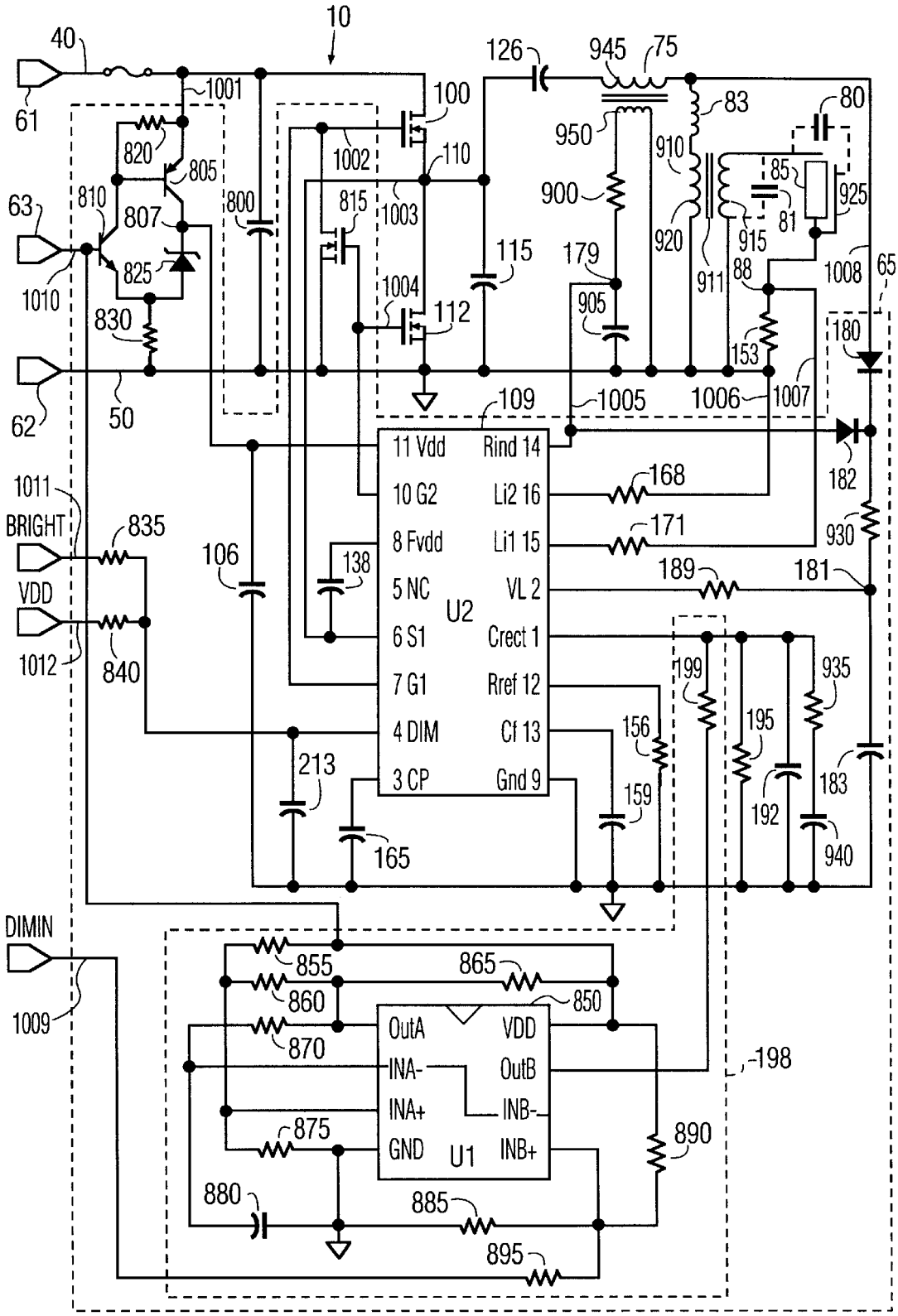
FIG. 1 is a schematic diagram of an inverter with lamp load in accordance with a first embodiment of the invention.

As shown in FIG. 1, a ballast 10, which includes a drive control circuit 65, is connected to a lamp 85. Lamp 85 can be, but is not limited to a fluorescent lamp of the cold cathode type, which is partially surrounded by a shield 925. The light from lamp 85 can be used to illuminate a liquid crystal display (LCD) of a computer (not shown). Shield 925 reflects light from lamp 85 toward the LCD. A portion of the electromagnetic interference (EMI) generated by lamp 85 is also blocked by shield 925 so as to minimize interfering with surrounding electrical devices. The parasitic capacitance between lamp 85 and shield 925 is represented by a parasitic capacitor 80.

Lamp 85 is connected to a secondary winding 915 of a transformer 910. The leakage inductance of transformer 910 is represented by leakage inductor 83. The parasitic capacitances associated with transformer 910 are represented by a capacitor 81. Parasitic capacitances associated with transformer 910 can exist between a primary winding 920 of transformer 910 and secondary 915, within secondary winding 915 and primary winding 920, between a ferrite core 911 of transformer 910 and secondary winding 915/primary winding 920 and between transformer 910 and ground.

A resonant circuit is formed by a resonant inductor 75, leakage inductor 83 and parasitic capacitors 80 and 81. Other than resonant inductor 75, there is no other discrete inductor or capacitor included which substantially affects the resonant frequency of the resonant circuit. There is also no discrete ballasting element, typically a capacitor, in series with lamp 85. The elimination of these discrete components from the resonant circuit or serially connected to lamp 85 reduces the parts count and cost of ballast 10. Power losses associated with these discrete components are also eliminated thereby improving the ballast efficiency.

Figures 2A, 2B, 2C, 2D:
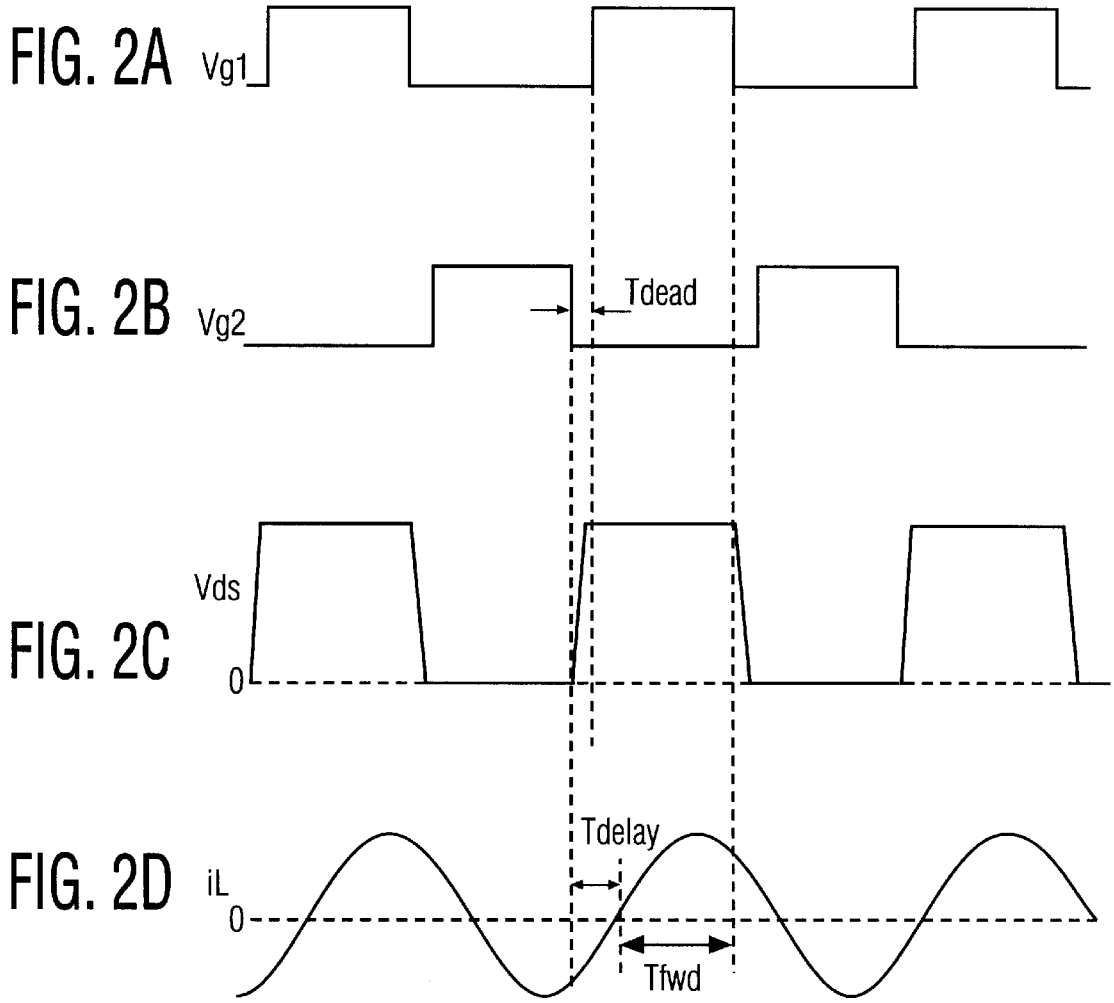
FIGS. 2A, 2B, 2C and 2D form a timing diagram of certain signals within the inverter and lamp load of FIG. 1.

A capacitor 126 is serially connected to resonant inductor 75. A pair of switches 100 and 112 are serially connected between a bus 40 and a bus 50. Bus 40 is at the high rail voltage. Bus 50 is at the low rail (common) voltage. Switches 100 and 112 are metal oxide semiconductor, field effect transistors (MOSFETs) which are joined together at a junction 110. A capacitor 115 is connected from a junction 110 to rail 50. Capacitor 126 is a blocking capacitor which filters out the DC portion of a trapezoidal voltage (vds) produced at junction 110. Trapezoidal voltage vds is illustrated in FIG. 2C. Capacitor 115 slows down the voltage transition (dv/dt) across the drain-source voltage of each switch 100 and 112 and thereby facilitates turn on and turn off of each switch when the voltage thereacross is substantially zero (i.e. zero voltage switching).

The half-bridge switching circuit (i.e. switching stage) includes switches 100 and 112. These switches are turned on and off by a drive control circuit IC 109. A gating signal vg1 is supplied by IC 109 along a gate line 1002 to control the conductive state of switch 100. A gating signal vg2 is supplied by IC 109 along a gate line 1004 to control the conductive state of switch 112. Switches 100 and 112 are never turned on at the same time and have ON time duty ratios of slightly less than 50% as shown in FIGS. 2A and 2B, respectively. A small dead time Tdead during which both switches are turned off is required to permit the zero voltage switching to be implemented.

A switch 815 prevents switch 100 from being turned on when switch 112 is turned on. Gating signals at high logic levels supplied at the same time to each of these switches for turning on each switch can occur during a fault (transient). The gates of switches 112 and 815 are connected to each other. When switch 112 is turned on by gating signal vg2 being at a high logic level, switch 815 is also turned on by gating signal vg2. When switch 815 is turned on, the gating signal vg1 is shunted to bus 50 thereby turning off switch 100. Accordingly, switch 100 can not remain in a conductive state when switch 112 is turned on.

A capacitor 800 is an input bypass capacitor for filtering the high frequency harmonics generated by switches 100 and 112. A DC voltage source, such as a battery (not shown), when connected to a pair of terminals 61 and 62 which terminate buses 40 and 50, respectively, provides a DC voltage between buses 40 and 50.

A pair of transistors (e.g. bipolar transistors) 805 and 810, a pair of resistors 820 and 830 and a zener diode 825 together form a linear regulator. This linear regulator is connected to a pin Vdd of IC 109 to power the latter. A TTL logic-level signal from an external source such as, but not limited to, a computer (not shown) is applied along a line 1010 to the base of transistor 810 through a terminal 63. When terminal 63 is at a high logic level, transistor 810 turns on which activates the linear regulator. The regulated voltage supplied to pin Vdd of IC 109 by the linear regulator is equal to the sum of the voltages across zener diode 825 and resistor 830. The voltage across resistor 830 is equal to the voltage at terminal 63 less the voltage across the base-emitter of switch 810. When terminal 63 is at a low logic level, transistor 810 turns off. The linear regulator is deactivated. No voltage is supplied to pin Vdd of IC 109. IC 109 and ballast 10 are shut down. In other words, when terminal 63 is at a high logic level, ballast 10 is turned on. When terminal 63 is at a low logic level, ballast 10 is turned off.

The linear regulator, which is connected to bus 40 through a line 1001, permits a relatively large range of DC power supplies to be connected between terminals 61 and 62 for operating ballast 10. Generally, DC power supplies ranging from about 8 volts to about 30 volts can be used for operating ballast 10. The linear regulator also minimizes the power required to operate IC 109. The power dissipated by IC 109 and its associated circuitry is minimized by the linear regulator maintaining a relatively constant level of voltage supplied to pin Vdd of IC 109. The voltage outputted by the linear regulator is substantially the same regardless of whether the voltage across terminals 61 and 62 is about 8 volts or about 30 volts.

IC 109 tracks the resonant frequency by sensing the current flowing through resonant inductor 75 and operates the half-bridge inverter at a switching frequency above the resonant frequency. A resistor 900 and a capacitor 905 form an integration circuit for sensing the current flowing through resonant inductor 75. The voltage across capacitor 905, which is approximately proportional to the integral of the voltage of a winding 950 coupled to inductor 75, represents the current through inductor 75. IC 109 senses the zero-crossing of current flowing through inductor 75 based on the voltage at an RIND pin of IC 109. Based on the zero-crossing timing and the feedback system, IC 109 determines the forward conduction time for switches 100 and 112. IC 109 drives the half-bridge inverter into an inductive mode so that there is a phase delay between the half-bridge node voltage vds and the inductor current iL as shown in FIGS. 2C and 2D. Capacitive mode operation of the inverter is prevented by a capacitive mode protection circuit within IC 109.

IC 109 regulates lamp power by sensing lamp current and lamp voltage. Lamp current is sensed by a sensing resistor 153. The lamp current signal is fed to a pair of pins Li1 and Li2 of IC 109 through a pair of resistors 171 and 168 along a pair of lines 1007 and 1006, respectively. The lamp current signal is amplified and rectified by IC 109. Lamp voltage is sensed from primary winding 920 by the combination of a line 1008, a diode 180, a pair of resistors 930 and 189 and a capacitor 183. The RC network of resistors 930 and 189 and capacitor 183 forms a low-pass filter which provides an average value of lamp voltage to be applied to a pin VL of IC 109. IC 109 calculates the lamp power by multiplying the lamp current signal and lamp voltage signal. The calculated lamp power is represented by a current which is supplied to a CRECT pin of IC 109. The current supplied to the CRECT pin by IC 109 flows into an RC network formed by a pair of resistors 935 and 195 and a pair of capacitors 192 and 940. This RC network has two poles and one zero to stabilize a feedback system. A DC voltage is provided at the CRECT pin through a low-pass filter formed by a resistor 195 and a capacitor 192. The DC voltage at the CRECT pin is compared with the voltage at a DIM pin of IC 109 by an error amplifier within IC 109. The output of the error amplifier controls the forward conduction time of switches 100 and 112. A feedback system maintains the voltage at the CRECT pin equal to the voltage at the DIM pin thereby regulating lamp power. Adjusting the voltage level at the DIM pin changes the level to which the lamp power will be set to.

The maximum lamp power as characterized by lamp brightness can be set to one of two levels by the TTL level (0 or 5 volts) applied to a terminal BRIGHT of ballast 10 from an external source (not shown). The BRIGHT terminal is connected to a resistor 835 by a line 1011. Another terminal VDD of ballast 10 is connected to resistor 840 by a line 1012. Terminal VDD 10 is connected to an external DC voltage source (e.g. 5 v) (not shown). When a low logic level (e.g. 0 volts) is applied to terminal BRIGHT, the voltage applied to the DIM pin, which sets the lamp power to one of two maximum levels, is determined by the voltage divider formed by a pair of resistors 835 and 840. When a high logic level (e.g. 5 volts) is applied to terminal BRIGHT, the voltage applied to the DIM pin increases and is clamped by IC 109 at about 3.0V, resulting in a higher maximum lamp power level. Actual dimming of the lamp is based, in part, on a control circuit 198 which includes a pulse width modulation (PWM) scheme.

The voltage at the CRECT pin is equal to the product of the current flowing out from the CRECT pin and the resistance connected from the CRECT pin to bus 50 (i.e. common). The voltage at the CRECT pin is maintained at the same voltage as the DIM pin by the feedback system. When an additional resistor is connected between the CRECT pin and bus 50, the total resistance between the CRECT pin and bus 50 is reduced. A higher current flows from the CRECT pin in order to maintain the voltage at the CRECT pin at the same voltage as the DIM pin. This higher current level represents that more power is delivered to the lamp increasing its brightness. When the resistance between the CRECT pin and bus 50 is increased, a lower current flows from the CRECT pin in maintaining the CRECT pin voltage equal to the DIM pin voltage. This lower current level represents that less power is delivered to the lamp decreasing its brightness. The amount of resistance between the CRECT pin and bus 50 is controlled by control circuit 198.

Control circuit 198 includes a dual voltage-comparator IC 850 having an open-collector output at its pin OUTB. IC 850 is available, for example, from National Semiconductor Corporation of Santa Clara, Calif. as part no. LM393M. The supply voltage for IC 850 is provided from terminal 63 of ballast 10. One of the two voltage comparators within IC 850 in combination with a plurality of resistors 855, 860, 865, 870 and 875 and a capacitor 880 form a triangular waveform oscillator at a frequency of 100 Hz–1 kHz. A second voltage comparator within IC 850 compares the voltage from a DIMIN terminal of ballast 10 with the triangular waveform across capacitor 880. The OUTB pin is at the bus 50 (common) potential when the voltage of the triangular waveform is greater than the voltage at an INB+ pin of IC 850. The OUTB pin is otherwise open (floating) when the voltage of the triangular waveform is less than the voltage at the INB+ pin of IC 850. In other words, a duty ratio Dpwm of the OUTB pin is determined by the voltage at terminal DIMIN. The DIMIN terminal is connected to an external DC voltage source (not shown) which varies in potential between about 0 to 5 volts. Resistor RDIM is therefore connected and disconnected between the CRECT pin and bus 50 at the Dpwm duty ratio of the OUTB pin. Lamp power will therefore jump between a higher and lower level at the Dpwm duty ratio. The average lamp power is proportional to the Dpwm duty ratio.

The level to which lamp 85 is dimmed is determined by the voltage applied to terminal DIMIN. The DIMIN terminal is connected to resistor 895 by a line 1009. Resistors 895 and 885 form a voltage divider, the voltage at the junction therebetween being biased by the voltage at terminal 63 through resistor 890. The higher the voltage at the DIMIN terminal, the smaller the duty ratio Dpwm thereby lowering the average lamp power and light level.

In the event of lamp short-circuit, a large current may flow through resonant inductor 75. A higher voltage across capacitor 905 results. This higher voltage is sensed by the combination of a diode 182, a pair of resistors 930 and 189 and capacitor 183. The RC network of resistors 930 and 189 and capacitor 183 forms a low-pass filter which provides an average value of voltage at capacitor 905 to be applied to a pin VL of IC 109. The average value of voltage represents the current flowing through inductor 75. The product of inductor 75 current and lamp 85 current can thereby be regulated. Saturation of inductor 75 is therefore prevented. IC 109, IC 850 and transistors 805, 810 and 815 can be integrated into a single IC chip if desired. Integrated circuit (IC) 109 includes a plurality of pins. A pin RIND is connected by a line 1005 to junction 179 of resistor 900 and capacitor 905. Resistor 900 and capacitor 905 form an integration circuit to sense current through inductor 75. The voltage across capacitor 905, which is approximately proportional to the integral of the voltage at the secondary winding 950 of inductor 75, represents the current through inductor 75. Therefore the input voltage at pin RIND reflects (a representative sample) the level of current flowing through inductor 75. A pin Vdd, which is connected to junction 807 of the linear regulator, supplies the voltage for driving IC 109. A pin LI2 is connected through a resistor 168 to bus 50 (common). A pin LI1 is connected through a resistor 171 to junction 88. The difference between the currents inputted to pins LI1 and LI2 reflects the sensed current flowing through lamp 85. The voltage at a pin VL, which is connected through a resistor 189 to junction 181, reflects somewhat the averaging voltage of lamp 85. The current flowing out of a CRECT pin into ground through a parallel combination of a resistor 195, a capacitor 192, and a series circuit of a resistor 935 and a capacitor 940, reflects the average power of lamp 85 (i.e. the product of lamp current and lamp voltage). A control circuit 198 changes the total resistance from CRECT pin to ground for dimming control.

Capacitor 192 serves to provide a filtered D.C. voltage across resistor 195. A resistor 156 is connected between a pin RREF and ground and serves to set the reference current within IC 109. A capacitor 159, which is connected between a CF pin and ground, sets the frequency of a current controlled oscillator (CCO). A capacitor 165, which is connected between a CP pin and ground, is employed for timing of the nonoscillating/standby mode. A GND pin is connected directly to bus 50 (common). A pair of pins G1 and G2 are connected directly to gates G1 and G2 of switches 100 and 112, respectively. A pin S1, which is connected directly to junction 110, represents the voltage at the source of switch 100. A pin Fvdd is connected to junction 110 through a capacitor 138 and represents the floating supply for IC 109. A capacitor 213 is connected between the DIM pin and ground. The voltage applied to the DIM pin reflects the maximum level of illumination as set by dim control circuit 198. Operation of the inverter and drive control circuit 65 is as follows.

Ignition Of The Lamp

Initially (i.e. during startup), as capacitor 106 is charged from the linear regulator output 807, switches 100 and 112 are in nonconducting and conducting states, respectively. The input current flowing into pin Vdd of IC 109 is maintained at a low level (less than 500 microamperes)

during this startup phase. Capacitor 138, which is connected between pin 51 and pin Fvdd, charges to a relatively constant voltage equal to approximately the voltage at pin Vdd and serves as the voltage supply for the drive circuit of switch 100. When the voltage across cap 106 exceeds a voltage turnon threshold (e.g. 8 volts), IC 109 enters its operating (oscillating/switching) state with switches 100 and 112 each switching back and forth between their conducting and nonconducting states at a frequency well above the resonant frequency determined by inductor 75, leakage inductor 83 and all parasitic capacitors 80 and 81.

Junction 110 varies between about 0 volts and the voltage applied to terminal 61 depending on the switching states of switches 100 and 112. Capacitor 115 serves to slow down the rate of rise and fall of the voltage at junction 110 thereby reducing switching losses and the level of EMI generated by the switching stage of the inverter. A relatively large operating current of, for example, 10–15 milliamps supplied to pin Vdd of IC 109 results. Capacitor 126 serves to block the D.C. voltage component from being applied to transformer 910.

The initial operating frequency of IC 109, which is about 150 kHz, is set by resistor 156 and capacitor 159 and the reverse diode conducting times of switches 100 and 112. IC 109 starts sweeping down its switching frequency at a rate set internal to IC 109 toward an unloaded resonant frequency (i.e. resonant frequency of inductor 75 and capacitor 80 prior to ignition of lamp 85—e.g. 60 kHz). As the switching frequency approaches the resonant frequency, the voltage across lamp 85 rises rapidly and is generally sufficient to ignite lamp 85. Once lamp 85 is lit, the current flowing therethrough rises from a few nano-amps to several milliamps. The current flowing through resistor 153, which is equal to the lamp current, is sensed at pins LI1 and LI2 based on the current differential therebetween as proportioned by resistors 168 and 171, respectively. The voltage of lamp 85, which is scaled by the turns ratio of the transformer 910, is detected by diode 180, resistors 930, and capacitor 183 resulting in a D.C. voltage, proportional to the averaging lamp voltage, at junction 181. The voltage at junction 181 is converted into a current by resistor 189 flowing into pin VL.

The current flowing into pin VL is multiplied inside IC 109 with the differential currents between pins LI1 and LI2 resulting in a rectified A.C. current fed out of pin CRECT into the parallel combination of capacitor 192, resistor 195, and, the series circuit of resistor 935 and capacitor 940. Capacitor 192 and resistor 195 convert the A.C. rectified current into a D.C. voltage. The voltage at the CRECT pin is forced equal to the voltage at the DIM pin by a feedback circuit/loop contained within IC 109. Regulation of power consumed by lamp 85 results.

A more detailed description regarding the circuitry and operation of IC 109 can be found in U.S. Pat. No. 5,680,017, issued Oct. 21, 1997, and which is incorporated herein by reference thereto.

Figure 3:
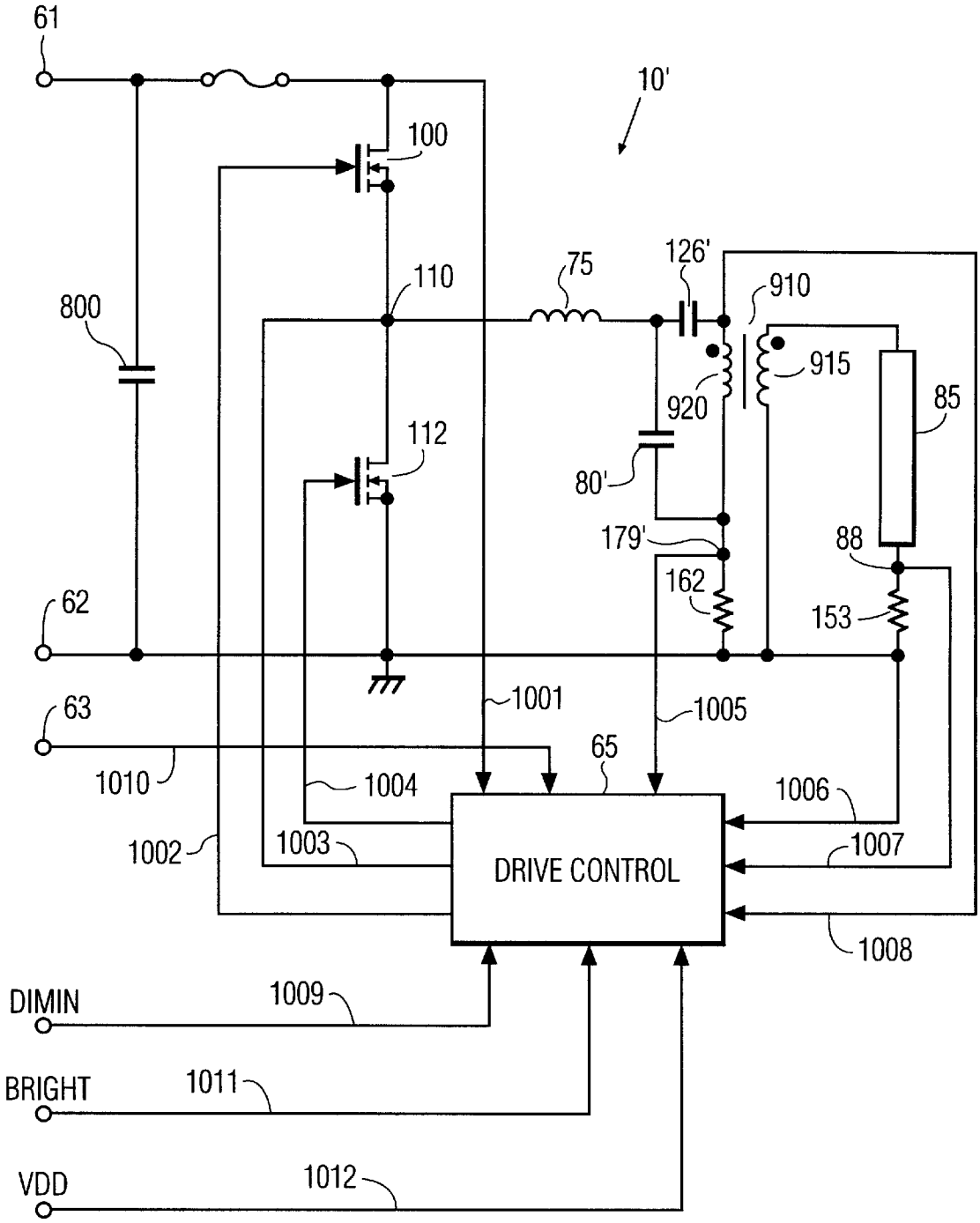
FIG. 3 is a schematic diagram of an inverter with lamp load in accordance with a second embodiment of the invention.

FIG. 3 illustrates an alternative embodiment of the invention. Those components in FIGS. 1 and 3 of similar construction and operation are identified by like reference numerals and will not be further discussed herein.

As shown in FIG. 3, a ballast 10' includes a capacitor 126' serves as both a blocking capacitor and ballasting element. The amount of power saved by eliminating the ballasting element in FIG. 1 is not achieved by the ballast of FIG. 3. Nevertheless, by placing capacitor 126' on the primary side of transformer 910 rather than on its secondary side less power is consumed than in a conventional ballast. The size and power loss of step-up transformer 910 is reduced. Unlike ballast 10 of FIG. 1, a discrete resonant capacitor 80' is required as part of the resonant circuit. Ballasting capacitor 126' and resonant capacitor 80' together provide DC voltage blocking. Unlike conventional ballasts, however, no additional DC blocking capacitor on the secondary of transformer 910 is required. The power loss associated with the equivalent series resistance (ESR) of an additional blocking capacitor is eliminated. A low-voltage, low-ESR capacitor can be used for ballasting capacitor 126'. Ballast 10', as compared to conventional ballasts, has a reduced parts count and cost and consumes less power.

In ballast 10, the sensing circuit for monitoring the current flowing through inductor 75 is formed by winding 950, resistor 900 and capacitor 905. The voltage at junction 179 of ballast 10 represents the current through resonant inductor 75. In ballast 10', the sensing circuit for monitoring the current flowing through inductor 75 is formed by a single resistor 162. Similar to ballast 10, the voltage at junction 179' represents the current through the resonant inductor 75.

It will thus be seen that the objects set forth above and those made apparent from the preceding description, are efficiently attained and since certain changes can be made in the above construction without departing from the spirit and scope of the invention, it is intended that all matter contained in the above description and shown in the accompanying drawings shall be interpreted as illustrative and not in a limiting sense.

We claim:

1. A ballast, comprising:

a switching stage having an output; and a circuit having a resonant frequency and coupled to the output of the switching stage;

wherein the only type of discrete element within the circuit substantially affecting the resonant frequency thereof is substantially inductive in electrical character.

2. The ballast of claim 1, wherein the circuit further includes a transformer having leakage inductance and parasitic capacitances which affect the resonant frequency.

3. The ballast of claim 1, wherein the circuit is coupled to a lamp load having at least one lamp and a shield and characterized by a parasitic capacitance between the at least one lamp and shield; the resonant frequency being affected by the parasitic capacitance of the lamp.

4. The ballast of claim 2, wherein the circuit is coupled to a lamp load having at least one lamp and a shield and characterized by a parasitic capacitance between the at least one lamp and shield; the resonant frequency being affected by the parasitic capacitance of the lamp.

5. The ballast of claim 2, wherein the transformer is connected without an intervening discrete ballasting element to a lamp load.

6. The ballast of claim 4, wherein the transformer is connected without an intervening discrete ballasting element to a lamp load.

7. The ballast of claim 1, wherein the switching stage is of the half bridge type comprising first and second controlled switches each of which is active to convert DC input power into AC power for a discharge lamp to be coupled to the circuit.

8. The ballast of claim 6, wherein the switching stage is of the half bridge type.

9. The ballast as claimed in claim 1 wherein the switching stage includes at least one switching transistor having equal on and off periods which are determined by said resonant frequency, and wherein a discharge lamp load is coupled to the circuit via connection means free of any discrete ballast elements.

10. The ballast as claimed in claim 1 wherein the circuit further includes a transformer having leakage inductance and parasitic capacitance, wherein only the discrete inductive element, the leakage inductance and parasitic capacitance significantly affect the resonant frequency of the circuit.

11. The ballast as claimed in claim 1 wherein the switching stage comprises at least one switching transistor that is switched on and off as a function of said resonant frequency and in a manner so as to deliver power during both the on and off periods of the switching transistor to a load coupled to the circuit.

12. The ballast as claimed in claim 1 wherein the switching stage comprises at least one switching transistor that is switched on and off at said resonant frequency and wherein both the on and off periods of the switching transistor are variable, and the switching stage and circuit have only a single resonant frequency which is the resonant frequency of said circuit.

13. The ballast as claimed in claim 11 wherein the switching stage further comprises a second switching transistor connected in series circuit with said at least one switching transistor to a pair of DC supply voltage terminals, and control means for switching said transistors on and off at said resonant frequency whereby a sinusoidal AC current is supplied to a discharge lamp when coupled to said circuit.

14. The ballast as claimed in claim 2 wherein the circuit is adapted for coupling to a discharge lamp load and the circuit resonant frequency is the frequency of power delivered to a discharge lamp load when coupled to said circuit.

15. A ballast, comprising:

a switching stage;

a circuit coupled to the switching stage, having a resonant frequency and including a serial combination of an inductor, a first capacitor and a primary winding of a transformer, that portion of the serial combination formed by the first capacitor and primary winding being in parallel with a second capacitor; and a lamp load coupled to a secondary winding of the transformer;

wherein the only discrete elements of the circuit substantially affecting the resonant frequency are the inductor and second capacitor.

16. The ballast as claimed in claim 9 wherein the lamp load is coupled to the secondary winding of the transformer via a further circuit devoid of any discrete capacitor element.

17. A method of ballasting a lamp load, comprising the steps of:

generating a varying DC voltage; and applying the varying DC voltage to a circuit having a resonant frequency wherein the only type of discrete element within the circuit substantially affecting the resonant frequency is substantially inductive in electrical character.

18. The method of claim 17, further including the step of controlling the resonant frequency based on the discrete element and a parasitic capacitance associated with a transformer included in the circuit.

19. The method of claim 17, further including the step of controlling the resonant frequency based on a leakage inductance associated with a transformer included in the circuit.

20. The method of claim 18, wherein the lamp load has at least one lamp and a shield and characterized by parasitic lamp capacitance between the at least one lamp and shield, and further including controlling the resonant frequency based on the parasitic lamp capacitance.

21. The method of claim 19, wherein the lamp load has at least one lamp and a shield and characterized by parasitic lamp capacitance between the at least one lamp and shield, and further including controlling the resonant frequency based on the parasitic lamp capacitance.

22. The method of claim 18, further including the step of controlling the resonant frequency based in part on a leakage inductance associated with the transformer.

23. A ballast circuit for a discharge lamp comprising:

input terminals for supplying an operating voltage to the ballast circuit, a transistor switching stage coupled to the input terminals and operative at a high frequency, a circuit having a resonant frequency corresponding to the switching stage high frequency and coupled to an output of the switching stage, said circuit including a transformer having leakage inductance and parasitic capacitance, wherein the resonant frequency of the circuit is determined substantially only by said leakage inductance and said parasitic capacitance.

24. The ballast circuit as claimed in claim 23 wherein the circuit further comprises a discrete inductor coupling the transformer to the output of the switching stage, wherein the discrete inductor, along with the leakage inductance and parasitic capacitance, together substantially determine the resonant frequency of the circuit.

* * * * *